US010087874B2

(12) United States Patent
Uchida et al.

(10) Patent No.: US 10,087,874 B2
(45) Date of Patent: Oct. 2, 2018

(54) CONTROL DEVICE FOR INTERNAL COMBUSTION ENGINE

(71) Applicant: NISSAN MOTOR CO., LTD., Kanagawa (JP)

(72) Inventors: Ryo Uchida, Kanagawa (JP); Futoshi Yoshimura, Kanagawa (JP); Tomoyoshi Date, Kanagawa (JP); Rina Kamio, Kanagawa (JP)

(73) Assignee: NISSAN MOTOR CO., LTD., Kanagawa (JP)

( * ) Notice: Subject to any disclaimer, the term of this patent is extended or adjusted under 35 U.S.C. 154(b) by 0 days.

(21) Appl. No.: 15/534,909

(22) PCT Filed: Dec. 9, 2014

(86) PCT No.: PCT/JP2014/082482
§ 371 (c)(1),
(2) Date: Jun. 9, 2017

(87) PCT Pub. No.: WO2016/092625
PCT Pub. Date: Jun. 16, 2016

(65) Prior Publication Data

US 2017/0350342 A1 Dec. 7, 2017

(51) Int. Cl.
*F02D 41/40* (2006.01)
*F02B 75/04* (2006.01)

(52) U.S. Cl.
CPC ..... *F02D 41/40* (2013.01); *F02B 75/045* (2013.01)

(58) Field of Classification Search
CPC ..... F02D 41/40; F02D 2041/0092; F02D 2041/0095; F02D 15/00; F02D 15/02; F02D 15/04; F02B 75/045; F02B 75/047; F02B 75/048
USPC ..... 123/481, 78 E, 78 F, 48 B, 299, 300; 701/103–105, 112, 113
See application file for complete search history.

(56) References Cited

U.S. PATENT DOCUMENTS

| | | | |
|---|---|---|---|
| 2014/0074381 | A1 | 3/2014 | Sczomak et al. |
| 2014/0182557 | A1 | 7/2014 | Arihara |

FOREIGN PATENT DOCUMENTS

| | | | |
|---|---|---|---|
| JP | 2009-250163 | A | 10/2009 |
| JP | 2009-293493 | A | 12/2009 |
| JP | 2012-241654 | A | 12/2012 |
| JP | 5626145 | B2 | 11/2014 |
| WO | 2013-141089 | A1 | 9/2013 |
| WO | 2014/136935 | A1 | 9/2014 |

*Primary Examiner* — Hai Huynh
(74) *Attorney, Agent, or Firm* — Osha Liang LLP

(57) ABSTRACT

A control device for an internal combustion engine has a controller configured to control a fuel injection valve arranged to directly inject a fuel into a combustion chamber, and a variable compression ratio mechanism arranged to vary an upper dead center position of a piston, and thereby to vary a compression ratio of the internal combustion engine. The controller is configured to control a fuel cut by which the fuel injection from the fuel injection valve is stopped, when a predetermined fuel cut condition is satisfied during a traveling of a vehicle. The fuel injection from the fuel injection valve is restarted when a predetermined fuel cut recovery condition is satisfied during the fuel cut.

6 Claims, 11 Drawing Sheets

CONTROL DEVICE FOR INTERNAL COMBUSTION ENGINE

BACKGROUND

Technical Field

This invention relates to a control device for an internal combustion engine in which a fuel is injected directly into a combustion chamber.

Related Art

Conventionally, there is known an internal combustion engine of an in-cylinder direct injection type in which a plurality of divided (split) injection of a fuel into a combustion chamber is performed during one combustion cycle. With this, a fuel injection amount per one time is decreased so as to decrease fuel adhesion to a wall surface and so on.

For example, in a patent document 1, when the fuel injection is restarted from a fuel cut state where the fuel injection into the combustion chamber is temporarily stopped, the injection amount ratio at a first time in the divide injection is decreased as a fuel cut time period during which the fuel injection into the combustion chamber is stopped is longer. With this, the discharge number of the exhaust particulate is suppressed.

However, in this patent document 1, when the fuel injection is restarted from the fuel cut state, the engine load is low. When the fuel injection amount at the one combustion cycle becomes less, the number of the fuel injection during the one combustion cycle may not be divided into plural number, and the injection amount ratio at the first time in the split injection may not be decreased. Accordingly, in the patent document 1, when the fuel injection is restarted from the fuel cut state, the discharge amount of the exhaust particulate and the discharge number of the exhaust particulate may be increased.

Patent Document 1: Japanese Patent Application No. 2012-241654

SUMMARY OF THE INVENTION

In one or more embodiments of the present invention, a control device for an internal combustion engine comprises a controller configured to control a fuel injection valve arranged to directly inject a fuel into a combustion chamber, and a variable compression ratio mechanism arranged to vary an upper dead center position of a piston, and thereby to vary a compression ratio of the internal combustion engine. The controller is configured to control a fuel cut by which the fuel injection from the fuel injection valve is stopped when a predetermined fuel cut condition is satisfied during a traveling of a vehicle. The fuel injection from the fuel injection valve is restarted when a predetermined fuel cut recovery condition is satisfied during the fuel cut. The compression ratio at the restart of the fuel injection from the fuel cut being set to be smaller than a normal state compression ratio determined in accordance with a driving state as a temperature of a wall surface of the combustion chamber becomes lower, so as to decrease adhesion of the fuel injected from the fuel injection valve into a cylinder to the piston. A rich spike by which the fuel injection amount from the fuel injection valve is temporarily increased is performed at the restart of the fuel injection from the fuel cut; and the compression ratio is finished to be returned to the normal state compression ratio after the end of the rich spike.

With this, the upper dead center position of the piston becomes low at the restart of the fuel injection from the fuel cut. It is possible to decrease the fuel adhesion to the piston. It is possible to suppress a discharge amount of an exhaust particulate, and a discharge number of the exhaust particulate.

DETAILED DESCRIPTION

Figure 1:
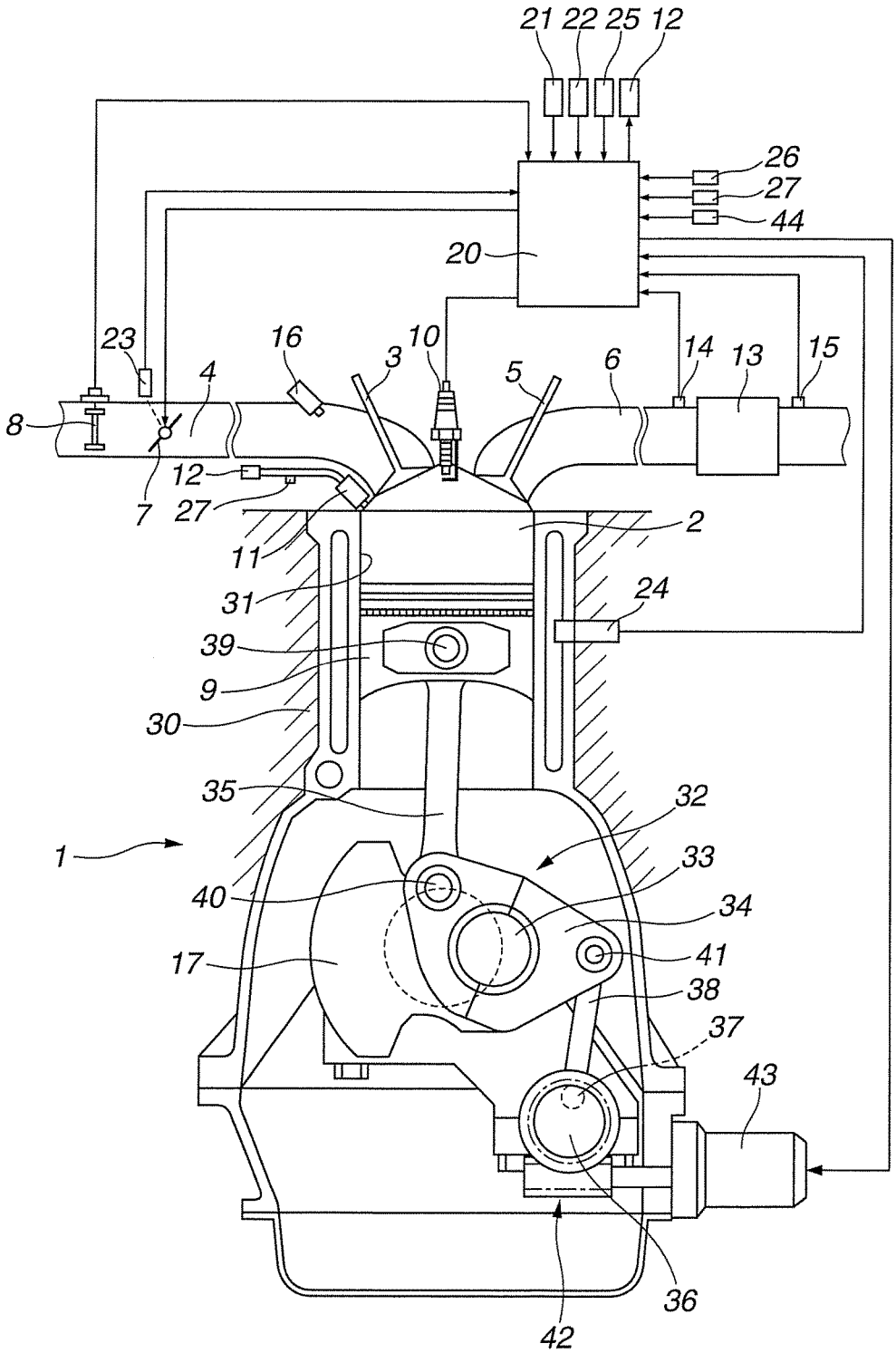
FIG. 1 is an explanative view schematically showing a schematic structure of an internal combustion engine to which one or more embodiments of the present invention is applied.

Hereinafter, embodiments of the present invention are illustrated in details with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention. FIG. 1 shows a schematic configuration of an internal combustion engine 1 to which one or more embodiments the present invention is applied. Besides, the internal combustion engine 1 uses a gasoline as a fuel, A combustion chamber 2 of the internal combustion engine 1 is connected through an intake valve 3 to an intake passage 4. Moreover, the combustion chamber 2 is connected through an exhaust valve 5 to an exhaust passage 6.

An electrically controlled throttle valve 7 is disposed on the intake passage 7. An air flow meter 8 is provided on an upstream side of the throttle valve 7. The air flow meter 8 is arranged to sense an intake air amount. A detection signal of the air flow member 8 is inputted into an ECU (engine control unit) 20.

An ignition plug 10 is disposed at a top portion of the combustion chamber 2 to confront a piston 9. A first fuel injection valve 11 is disposed on a side portion of this combustion chamber 2 on the intake passage's side. The first fuel injection valve 11 is arranged to directly inject the fuel into the combustion chamber 2.

The fuel pressured by a high pressure fuel pump (not shown) to have a relatively high pressure is introduced into the first fuel injection valve 11 through a pressure regulator 12. The pressure regulator 12 is arranged to vary a pressure of the fuel (fuel pressure) supplied to the first fuel injection valve 11 based on a control command from the ECU 20, A three-way catalyst 13 is disposed on the exhaust passage 6. A first air-fuel ratio sensor 14 is disposed on the exhaust passage 6 on an upstream side of the three-way catalyst 13. A second air-fuel ratio sensor 15 is disposed on the exhaust passage 6 on a downstream side of the three-way catalyst 13. The air-fuel ratio sensors 14 and 15 may be oxygen sensors arranged to sense only a rich and lean of the air fuel ratio. Alternatively, the air-fuel ratio sensors 14 and 15 may be wide area type air-fuel ratio sensors by which an output according to the value of the air fuel ratio can be obtained.

The ECU 20 includes a microcomputer. The ECU 20 is configured to perform various controls of the internal combustion engine 1. The ECU 20 is configured to perform the operations based on signals from various sensors. The various sensors are the above-described air flow meter 8, the first and second air-fuel ratio sensors 14 and 15, an accelerator opening degree sensor 21 arranged to sense an opening degree (depression amount) of an accelerator pedal operated by the driver, a crank angle sensor 22 arranged to sense a crank angle of a crank shaft 17, and the engine speed, a throttle sensor 23 arranged to sense an opening degree of the throttle valve 7, a water temperature sensor 24 arranged to sense a coolant temperature of the internal combustion engine 1, an oil temperature sensor 25 arranged to sense an oil temperature of an engine oil, a vehicle speed sensor 26 arranged to sense a vehicle speed, a fuel pressure sensor 27 arranged to sense the fuel pressure supplied to the first fuel injection valve 11, and so on.

The ECU 20 is configured to control the injection amount and the injection timing of the first fuel injection valve 11, an ignition timing by the ignition plug 10, the opening degree of the throttle valve 7, and so on, based on these detection signals.

Besides, the internal combustion engine 1 includes a second fuel injection valve 16 disposed on the downstream side of the throttle valve 7, and arranged to inject the fuel into the intake passage 4 in each cylinder. That is, it is possible to supply the fuel into the combustion chamber 2 by the port injection.

Moreover, the internal combustion engine 1 includes a variable compression ratio mechanism 32 arranged to vary a compression ratio (engine compression ratio) by varying an upper dead center position of the piston 9 arranged to be reciprocated within the cylinder 31 of the cylinder block 30.

The variable compression ratio mechanism 32 uses a multi ink piston crank mechanism in which the piston 9 and a crank pin 33 of the crank shaft 17 are linked by a plurality of links. The variable compression ratio mechanism 32 includes a lower link 34 rotatably mounted on the crank pin 33; an upper link 35 connecting this lower link 34 and the piston 9; a control shaft 36 including an eccentric shaft portion 37; and a control link 38 connecting the eccentric shaft portion 37 and the lower link 34.

The upper link 35 includes one end rotatably mounted to the piston pin 39, and the other end rotatably linked to the lower link 34 by a first link pin 40. The control link 38 includes one end rotatably linked to the lower link 34 by a second link pin 41, and the other end rotatably mounted to the eccentric shaft portion 37.

The control shaft 36 is disposed parallel to the crank shaft 17. The control shaft 36 is rotatably supported by the cylinder block 30. The control shaft 36 is driven and rotated through a gear mechanism 42 by an electric motor 43, so that a rotation position of the control shaft 36 is controlled.

A posture of the lower link 34 by the control link 38 is varied by varying the rotation position of the control shaft 36 by the electric motor 43. With this, a piston motion (stroke characteristics) of the piston 9, that is, an upper dead center position and a lower dead center position are varied, so that the compression ratio of the internal combustion engine 1 is continuously varied and controlled. Besides, the compression ratio of the internal combustion engine 1 is measured, for example, from a detection value of an electric motor rotation angle sensor 44 arranged to sense a rotation angle of an output shaft of the electric motor 43.

The ECU 20 is configured to perform the fuel cut control to stop the fuel injections of the first fuel injection valve 11 and the second fuel injection valve 16. For example, when the engine speed is equal to or greater than a predetermined fuel cut rotation speed and the throttle valve 7 is fully closed, the fuel cut conditions are satisfied. Accordingly, the ECU 20 performs the fuel cut control. The ECU 20 is configured to restart the fuel injection of the first fuel injection valve 11 when predetermined fuel cut recovery conditions are satisfied during the fuel cut control. For example, when the throttle valve 7 is not in the fully closed state by the depression of the accelerator pedal, or when the engine speed becomes equal to or smaller than the predetermined fuel cut recovery rotation speed, the fuel cut recovery conditions are satisfied. Accordingly, the ECU 20 finishes the fuel cut control.

When the fuel cut control is performed, the relatively much oxygen are supplied to the three-way catalyst 13. That is, the three-way catalyst 13 adsorbs the much oxygen during the fuel cut control. The three-way catalyst 13 may be hard to reduce NOx by depriving of the oxygen from the NOx in the exhaust air at the end of the fuel cut control. Accordingly, in this embodiment, when the fuel injection is restarted after the end of the fuel cut control, the rich spike by which the fuel injection amount injected from the first fuel injection valve 11 is temporarily increased is performed. With this, the recovery of the exhaust air purification capability (NOx reduction capability) of the three-way catalyst 13 is promoted.

In this case, the combustion of the internal combustion engine 1 is stopped during the fuel cut control. Accordingly, the wall surface temperature of the combustion chamber 2, that is, the temperature of the piston 9, the cylinder inner wall surface and so on is decreased. Therefore, when the fuel injection of the first fuel injection valve 11 is restarted after the end of the combustion cut control, the adhesion amount of the fuel injected from the first fuel injection valve 11 into the combustion chamber 2 to the piston 9 and so on is increased. The discharge amount and the discharge number of the exhaust particulate may be increased.

In one or more embodiments the present invention, the compression ratio when the fuel injection is restarted from the first fuel injection valve 11 during the intake process after the fuel cut control is set to be decreased to be smaller than the normal state compression ratio determined in accordance with the driving state, in accordance with the decrease of the temperature of the wall surface of the combustion chamber 2 during the fuel cut.

For example, in a case where the accelerator pedal is not depressed and the engine speed becomes equal to or smaller than the predetermined fuel cut recovery rotation speed so that the fuel cut recovery conditions are satisfied, the compression ratio at the restart of the fuel injection is set to be smaller than at least the normal compression ratio at the idling drive. Moreover, in a case where the accelerator pedal is depressed during the fuel cut control and the throttle valve 7 is not in the fully closed state so that the fuel cut recovery conditions are satisfied, the compression ratio at the restart of the fuel injection is set to be smaller than at least the normal compression ratio in the driving state at the fuel injection restart.

Figure 2:
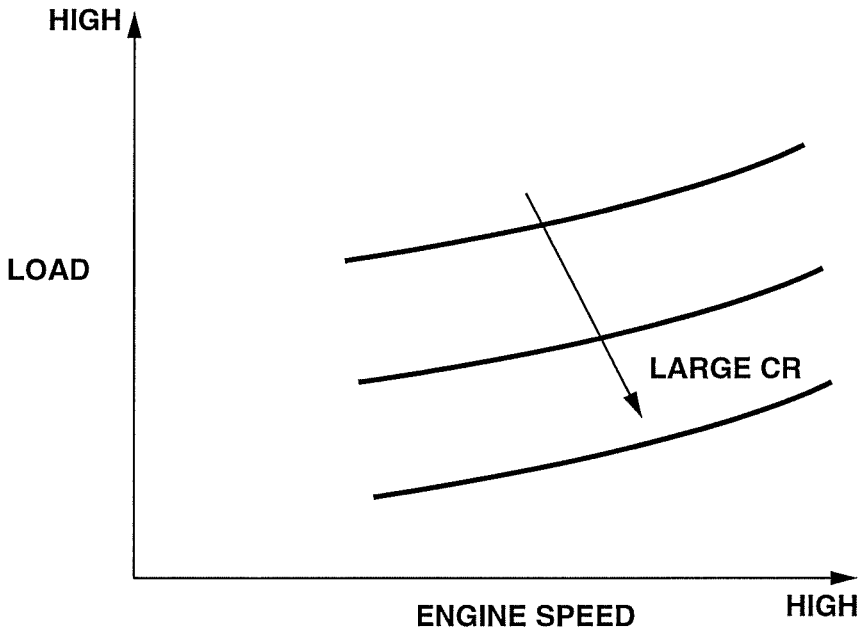
FIG. 2 is a normal state compression ratio calculation map.

The normal state compression ratio is calculated, for example, by using a normal state compression ratio calculation map shown in FIG. 2. In this normal state compression ratio calculation map, the calculated normal state compression ratio becomes higher as the engine load is lower, and as the engine speed is higher.

Figure 3:
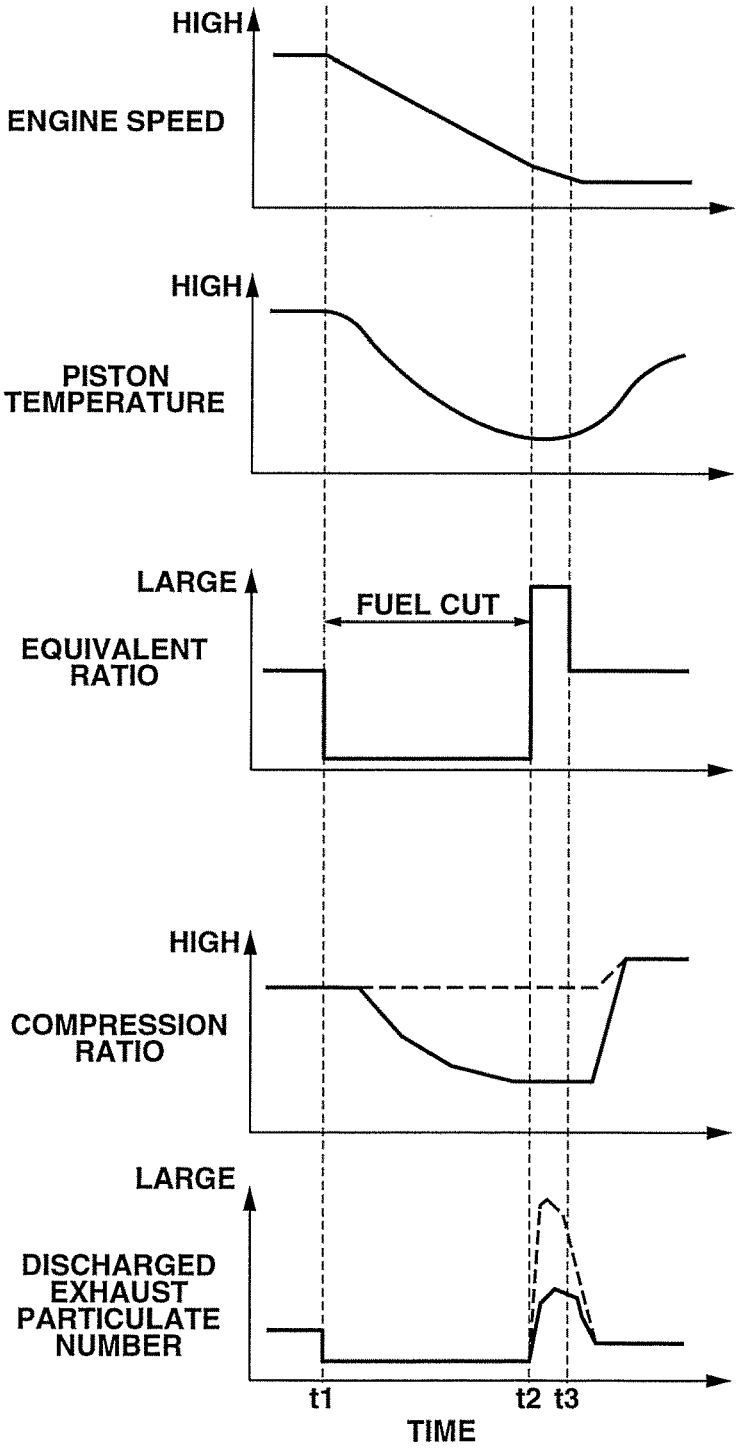
FIG. 3 is a timing chart at a deceleration of a vehicle with a fuel cut in a first embodiment.

FIG. 3 is a timing chart showing a state at a transition from the fuel cut control to a timing after the end of the fuel cut, in the first embodiment.

In FIG. 3, the fuel cut conditions are satisfied at time t1. At time t2 at which the engine speed becomes equal to or smaller than the predetermined fuel cut recovery rotation speed by without the depression of the accelerator pedal, the fuel cut recovery condition is satisfied. Moreover, the equivalent ratio is controlled to be temporarily increased during a predetermined period from time t2. That is, the rich spike by which the fuel injection amount injected from the first fuel injection valve 11 is temporarily increased is performed during the time period from time t2 to time t3.

In the first embodiment, the compression ratio at the end of the fuel cut control is set to be smaller than the normal state compression ratio shown by a broken line in FIG. 3. In particular, the compression ratio at the end of the fuel cut control is set to be smaller than the normal state compression ratio at the idling drive.

Besides, the compression ratio is varied to the normal state compression ratio after a predetermined time period elapses from the time t3 at which the rich spike is finished. This is because the temperature of the piston 9 which is decreased during the fuel cut may not be sufficiently increased at the time t3 at which the rich spike is finished.

In this way, when the fuel injection is restarted from the first fuel injection valve 11, the compression ratio is set to be smaller than the normal state compression ratio. With this, the upper dead center position of the piston 9 is lowered. Accordingly, it is possible to decrease the adhesion of the fuel injected from the first fuel injection valve 11 to the piston 9. Moreover, it is possible to increase the residual gas ratio within the cylinder by decreasing the compression ratio, and thereby to promote the increase of the temperature of the wall surface of the combustion chamber 2 which is decreased at the fuel cut. Therefore, it is possible to largely decrease the discharge number of the exhaust particulate when the fuel injection is restarted from the first fuel injection valve 11 after the fuel cut control, relative to a case where the compression ratio is set to the normal state compression ratio shown by the broken line in FIG. 3. Furthermore, it is possible to suppress the discharge amount of the exhaust particulate. That is, it is possible to attain both the fuel decrease by the fuel cut control, and the suppression of the deterioration of the exhaust performance immediately after the end of the fuel cut control.

Moreover, in this first embodiment, the compression ratio at the restart of the fuel injection from the first fuel injection valve 11 is lowered as the temperature of the wall surface of the combustion chamber 2 is lowered, so that the upper dead center position of the piston 9 is lowered as the temperature of the wall surface of the combustion chamber 2 is lowered. That is, the compression ratio at the restart of the fuel injection from the first fuel injection valve 11 is set so that the injected fuel is harder to reach the piston 9 as the temperature of the wall surface of the combustion chamber 2 is lowered. This is because the adhesion amount of the injected fuel to the piston 9 at the restart of the fuel injection of the first fuel injection valve 11 is easier to be increased as the temperature of the wall surface of the combustion chamber 2 becomes lower.

Accordingly, in the first embodiment, in a case where the fuel injection is restarted from the first fuel injection valve 11 when the fuel cut recovery conditions are satisfied, it is possible to effectively decrease the adhesion amount of the injected fuel to the piston 9.

Moreover, in the first embodiment, the compression ratio is previously controlled to be lowered from during the fuel cut control in accordance with the temperature of the wall surface of the combustion chamber 2. Accordingly, when the fuel injection is restarted from the first injection valve 11, it is possible to set the compression ratio to the lower value in accordance with the temperature of the wall surface of the combustion chamber 2, without delay. It is possible to effectively decrease the adhesion amount of the fuel to the piston 9.

Besides, in the first embodiment, the compression ratio is returned to the normal state compression ratio after the end of the rich spike. Accordingly, it is possible to effectively decrease the fuel adhesion to the wall surface of the combustion chamber 2 due to the rich spike. This is advantageous for decreasing the discharge number of the exhaust particulate.

Figure 4:
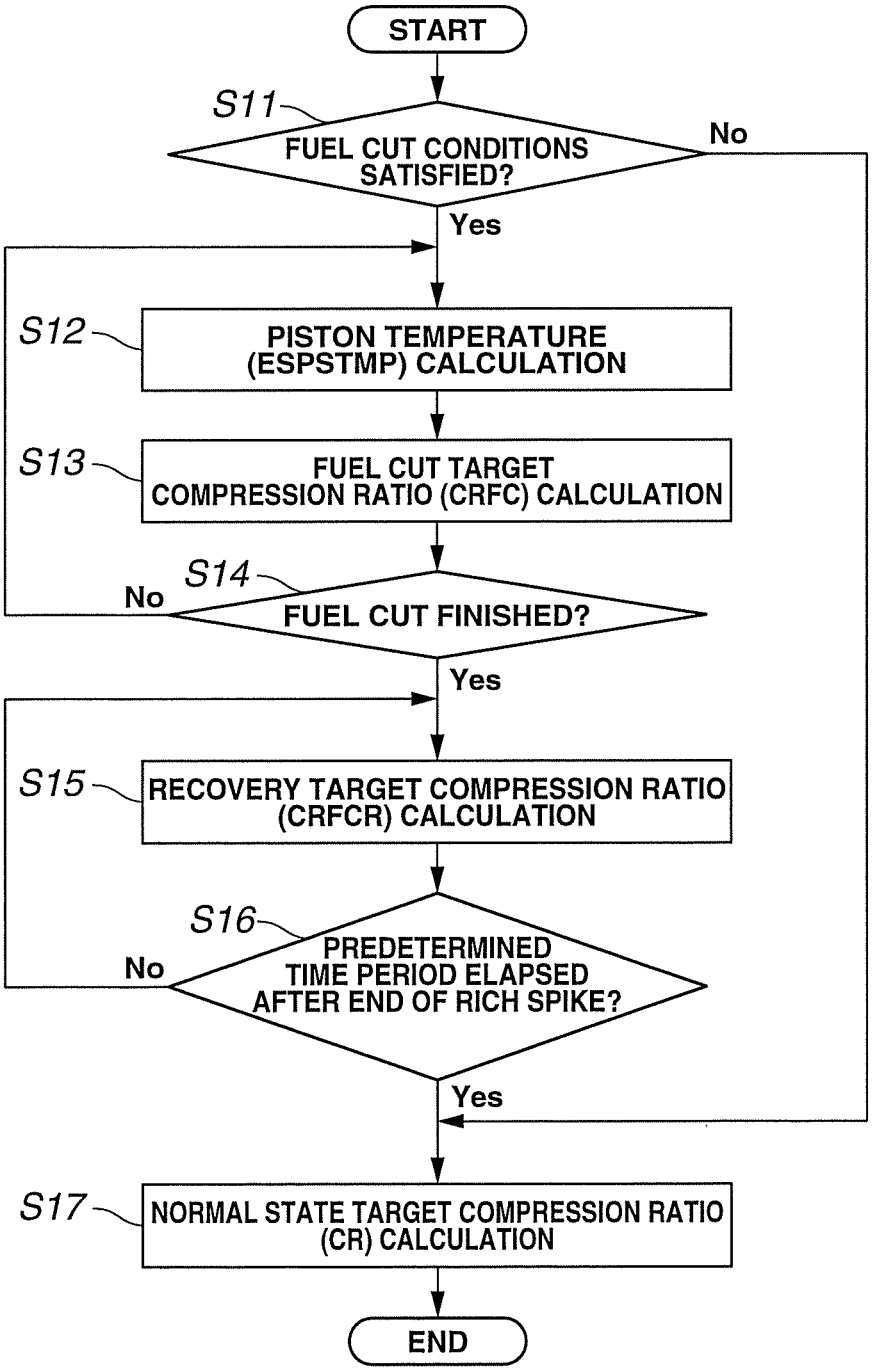
FIG. 4 is a flow chart showing a flow of a control in the first embodiment.
Figure 5:
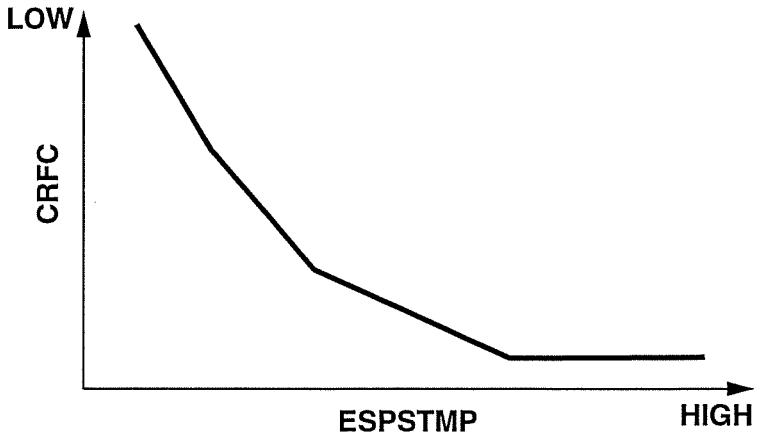
FIG. 5 is a fuel cut target compression ratio map.

FIG. 4 is a flow chart showing a flow of the control in the above-described first embodiment. At S11, it is judged whether or not the fuel cut conditions are satisfied. When the fuel cut conditions are satisfied, the process proceeds to S12. When the fuel cut conditions are not satisfied, the process proceeds to S17. At S12, the piston temperature (ESPSTMP) is calculated from a predetermined calculation formula by using the engine load immediately before the fuel cut control, the accumulated intake air amount during the fuel cut control, and so on. Besides, the piston temperature (ESPSTMP) may be calculated by using the coolant temperature of the internal combustion engine 1, and the oil temperature of the engine oil. At S13, the fuel cut target compression ratio (CRFC) which is the target value of the compression ratio during the fuel cut is calculated. This fuel cut target compression ratio (CRFC) is calculated, for example, by using the fuel cut target compression ratio calculation map shown in FIG. 5. The fuel cut target compression ratio is lowered as the piston temperature (ESPSTMP) is lowered. Besides, the fuel cut target compression ratio is set so that the discharge amount of the exhaust particulate is not largely deteriorated even when the fuel is injected from the first fuel injection valve 11 at this compression ratio.

At S14, it is judged whether or not the fuel cut is finished. That is, it is judged whether or not the fuel cut recovery conditions are satisfied. When the fuel cut recovery conditions are satisfied, the process proceeds to S15. When the fuel cut recovery conditions are not satisfied, the process proceeds to S12. At S15, the recovery target compression ratio (CRFCR) which is the target value of the compression ratio during the rich spike is set to the fuel cut target compression ratio (CRFC) calculated immediately before the fuel cut recovery conditions are satisfied. At S16, it is judged whether or not the rich spike is finished. In particular, when the predetermined time period elapses from the end of the rich spike, the process proceeds to S17. Otherwise, the process proceeds to S15. Besides, it may be set that the process proceeds to S17 when the rich spike is finished at S16. At S17, the target compression ratio (CR) is set to the normal state compression ratio (CR) calculated from the above-described normal state compression ratio calculation map of FIG. 2 by using the current engine load and the current engine speed.

Hereinafter, other embodiments according to the present invention are explained. Constituting elements which are the same as the above-described first embodiment have the same symbols. The repetitive explanations are omitted.

A second embodiment of the present invention is explained with reference to FIG. 6 to FIG. 8. The second embodiment has a configuration substantially identical to that of the above-described first embodiment. In the second embodiment, the compression ratio at the restart of the fuel injection from the first fuel injection valve 11 after the fuel cut control is set to be lower than the normal state compression ratio determined in accordance with the driving state, like the first embodiment. Besides, in this second embodiment, the compression ratio at the restart of the fuel injection of the first fuel injection valve 11 is set to be lower as the time period during which the immediately preceding fuel cut control is performed becomes longer.

Figure 6:
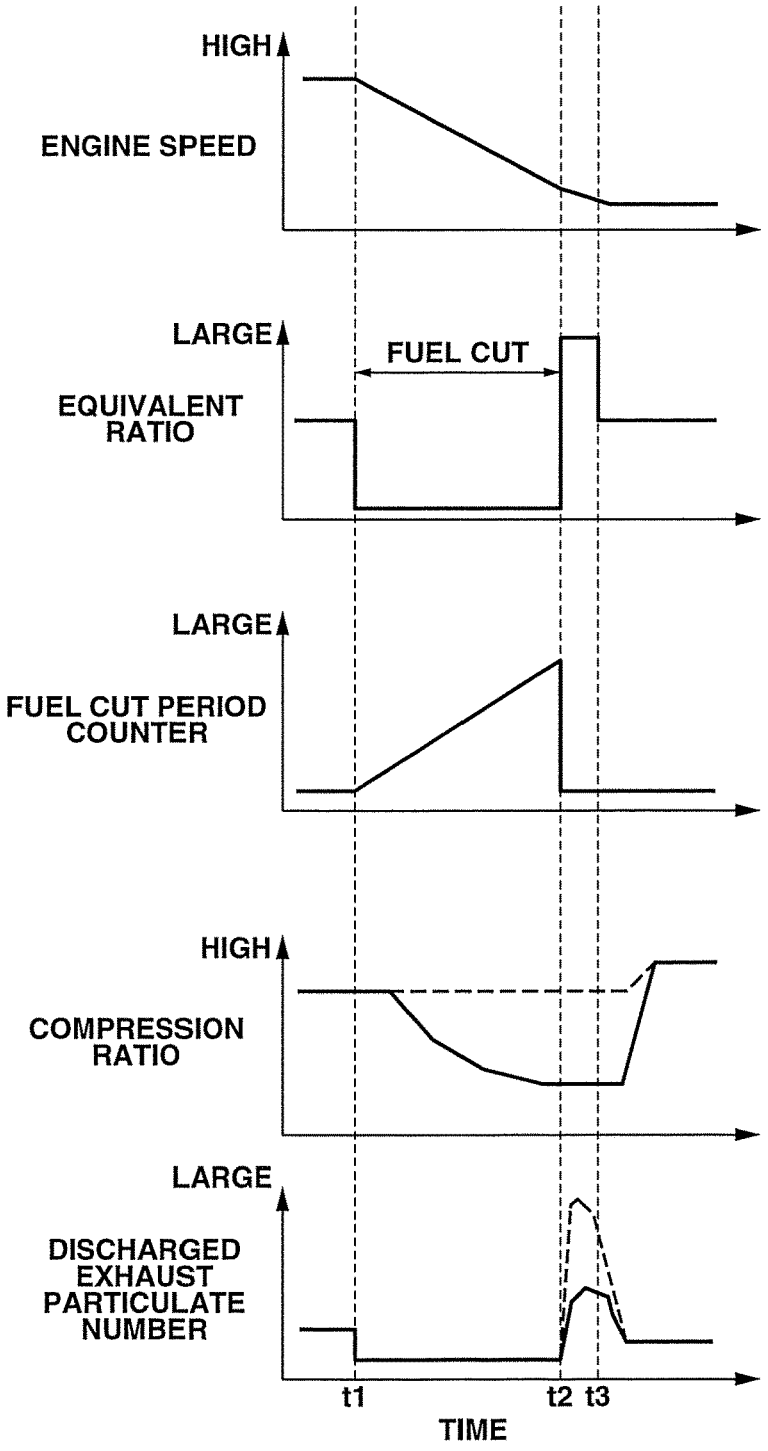
FIG. 6 is a timing chart at a deceleration of a vehicle with a fuel cut in a second embodiment.

In FIG. 6, the fuel cut conditions are satisfied at time t1. At time t2 at which the engine speed becomes equal to or smaller than the predetermined fuel cut recovery rotation speed without the depression of the accelerator pedal, the fuel cut recovery conditions are satisfied. Moreover, the equivalent ratio during the predetermined period from the time t2 is controlled to be temporarily increased. That is, the rich spike by which the fuel injection amount injected from the first fuel injection valve 11 is temporarily increased is performed from time t2 to time t3.

In this second embodiment, the compression ratio at which the fuel injection is restarted after the end of the fuel cut control is set to be lower as the time period from the time t1 to the satisfaction of the fuel cut recovery condition becomes longer, that is, as the fuel cut period counter which is counted at every constant time from the time t1 until the fuel cut recovery conditions are satisfied becomes larger. This is because the wall temperature of the combustion chamber 2 becomes lower as the fuel cut control becomes longer, so that the adhesion amount of the fuel injected at the fuel injection restart of the first fuel injection valve 11 to the piston 9 is easy to be increased.

Therefore, in this second embodiment, it is also possible to largely decrease the discharge number of the exhaust particulate when the fuel injection is restarted from the first fuel injection valve 11 after the end of the fuel cut control, relative to a case where the compression ratio is set to the normal state compression ratio as shown by a broken line in FIG. 6. With this, it is possible to suppress the discharge amount of the exhaust particulate. Moreover, in this second embodiment, it is also possible to attain the operations and the effects which are identical to those of the above-described first embodiment.

Figure 7:
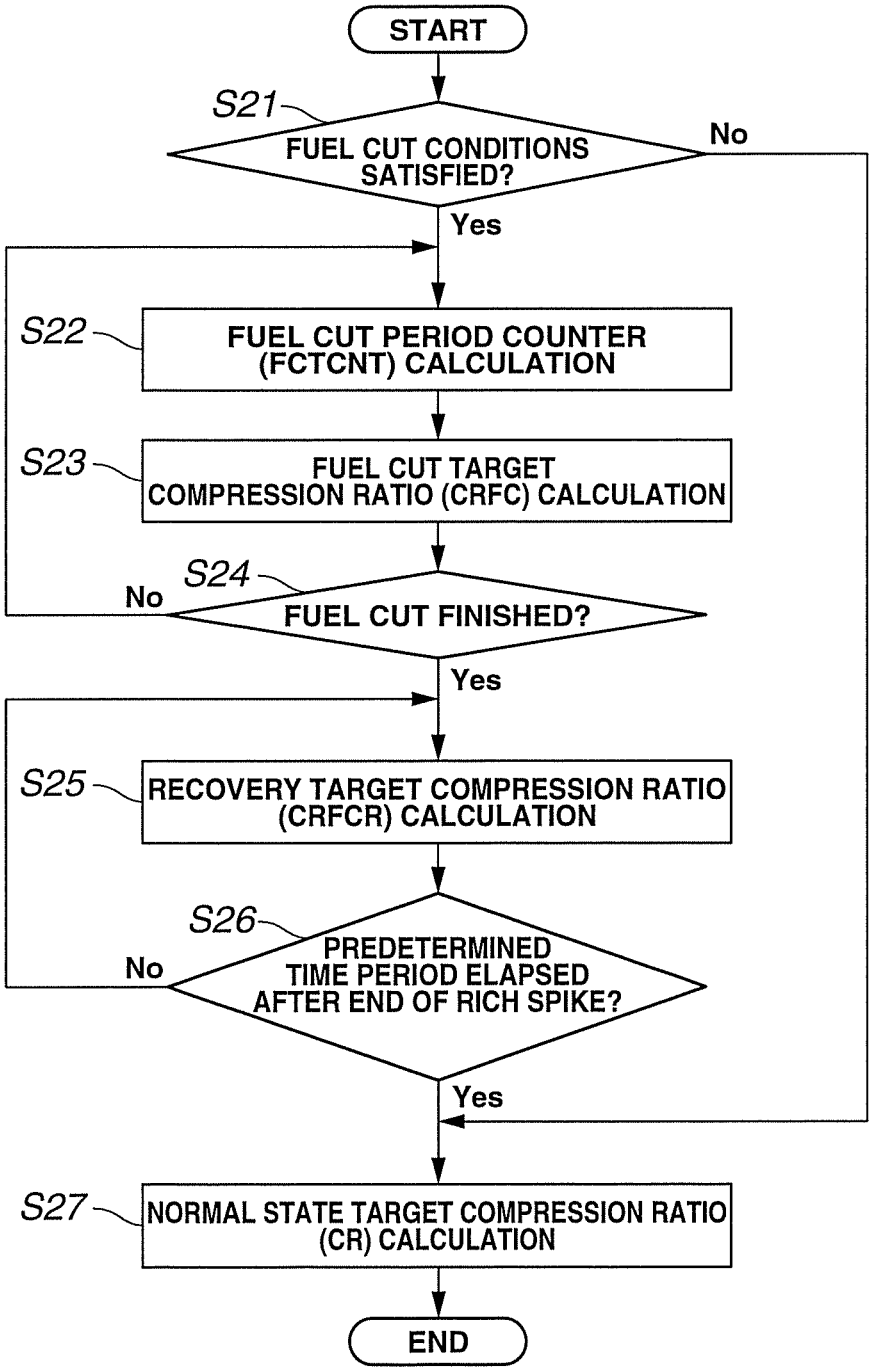
FIG. 7 is a flow chart showing a flow of a control in the second embodiment.
Figure 8:
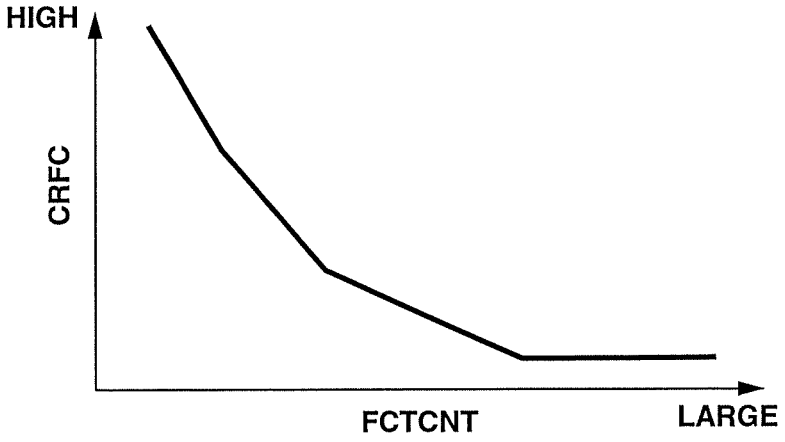
FIG. 8 is a fuel cut target compression ratio map.

FIG. 7 is a flow chart showing a flow in the above-described second embodiment. At S21, it is judged whether or not the fuel cut conditions are satisfied. When the fuel cut conditions are satisfied, the process proceeds S22. When the fuel cut conditions are not satisfied, the process proceeds S27. At S22, the fuel cut period counter (FCTCNT) is calculated. At S23, the fuel cut target compression ratio (CRFC) which is the target value of the compression ratio during the fuel cut is calculated. This fuel cut target compression ratio (CRFC) is calculated, for example, by using the fuel cut target compression ratio calculation map shown in FIG. 8. The fuel cut target compression ratio (CRFC) becomes lower as the fuel cut period counter (FCTCN) is greater. Besides, the fuel cut target compression ratio is set so that the discharge amount of the exhaust particulate is not largely deteriorated even when the fuel is injected from the first injection valve 11 at this compression ratio.

At S24, it is judged whether or not the fuel cut is finished. That is, it is judged whether or not the fuel cut recovery conditions are satisfied. When the fuel cut recovery conditions are satisfied, the process proceeds S25. When the fuel cut recovery conditions are not satisfied, the process proceeds to S22. At S25, the recovery target compression ratio (CRFCR) which is the target value of the compression ratio during the rich spike is set to the fuel cut target compression ratio (CRFC) which is calculated immediately before the satisfaction of the fuel cut recovery conditions. At S26, it is judged whether or not the rich spike is finished. Specifically, when the predetermined time period elapses from the end of the rich spike, the process proceeds to S27. Otherwise, the process proceeds to S25. Besides, at S26, it may be set that the process proceeds S27 when the rich spike is finished. At S27, the target compression ratio (CR) is set to the normal state compression ratio (CR) which is calculated from the above-described normal state compression ratio calculation of FIG. 2 by using the current engine load and the current engine speed.

A third embodiment of the present invention is explained with reference to FIG. 9 to FIG. 11. The third embodiment has a configuration substantially identical to that of the above-described first embodiment. In the third embodiment, the compression ratio at the restart of the fuel injection from the first fuel injection valve 11 after the end of the fuel cut control is set to be smaller than the normal state compression ratio determined in accordance with the driving state, like the above-described first embodiment. In this third embodiment, when the fuel injection of the first fuel injection valve 11 is restarted during the intake process, the fuel injection timing is advanced in accordance with the decrease of the compression ratio to be relatively closer to the upper dead center.

Figure 9:
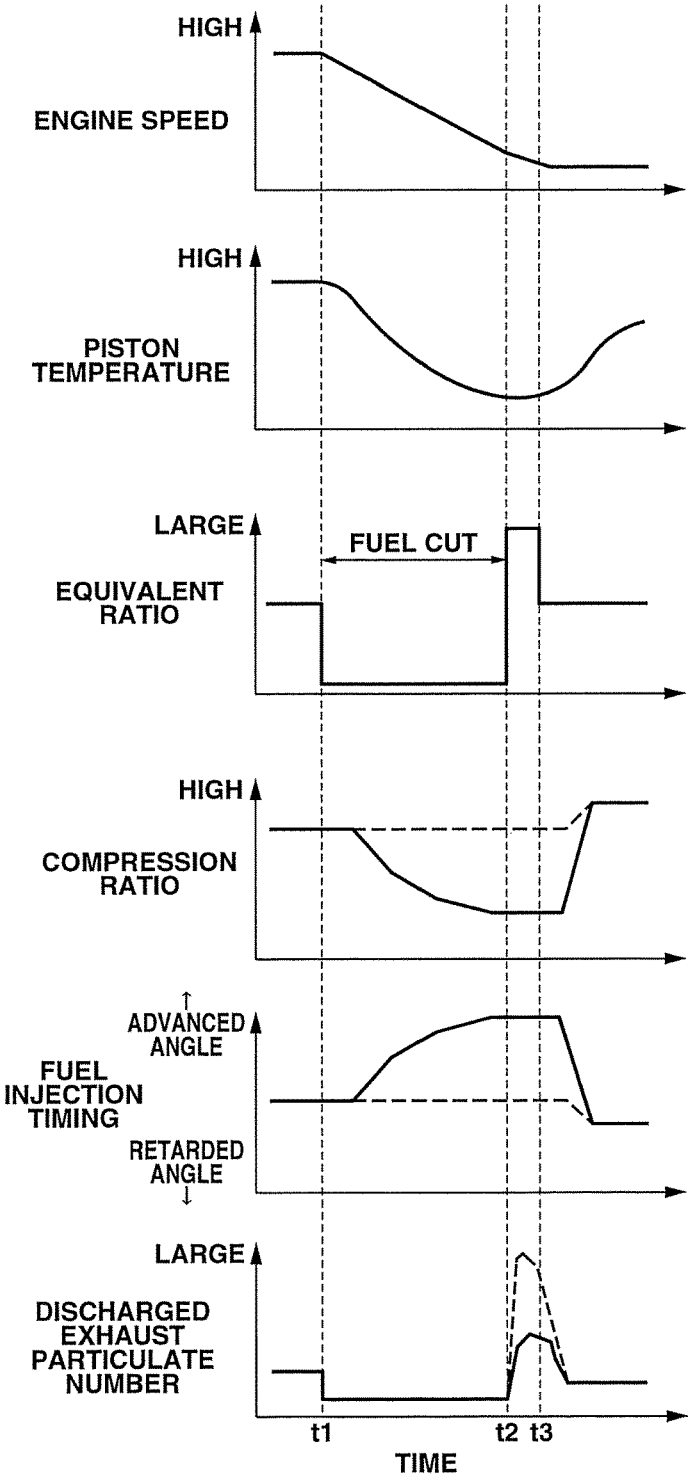
FIG. 9 is a timing chart at a deceleration of a vehicle with a fuel cut in a third embodiment.

In FIG. 9, the fuel cut conditions are satisfied at time t1. At time t2 at which the engine speed becomes equal to or smaller than the predetermined fuel cut recovery rotation speed without the depression of the accelerator pedal, the fuel cut recovery conditions are satisfied. Moreover, the equivalent ratio during the predetermined period from the time t2 is controlled to be temporarily increased. That is, the rich spike by which the fuel injection amount injected from the first fuel injection valve 11 is temporarily increased is performed from time t2 to time t3.

In this third embodiment, the fuel injection timing at the restart of the fuel injection after the end of the fuel cut control is set to be advanced in accordance with the compression ratio which is decreased in accordance with the temperature decrease of the wall temperature of the combustion chamber 2. That is, the fuel injection timing at the restart of the fuel injection of the first fuel injection valve 11 is advanced as the compression ratio set at the satisfaction of the fuel recovery conditions becomes lower.

In this third embodiment, when the fuel injection is restarted from the first injection valve 11 after the end of the fuel cut control, it is also possible to largely decrease the discharge number of the exhaust particulate, relative to a case where the compression ratio is set to the normal state compression ratio as shown by a broken line in FIG. 9. With this, it is possible to suppress the discharge amount of the exhaust particulate. Moreover, in this third embodiment, it is also possible to attain the operations and the effects which are identical to those of the above-described first embodiment.

Furthermore, in this third embodiment, it is possible to improve the mixture of the fuel within the combustion chamber 2 by early injecting the fuel while suppressing the adhesion of the fuel injected from the first fuel injection valve 11 to the piston 9. That is, in this third embodiment, it is possible to further suppress the discharge amount of the exhaust particulate, relative to a case where the compression ratio is decreased to be smaller than the normal state compression ratio at the end of the fuel cut control, and the fuel injection timing is not advanced in accordance with the compression ratio set at the satisfaction of the fuel cut recovery conditions.

Figure 10:
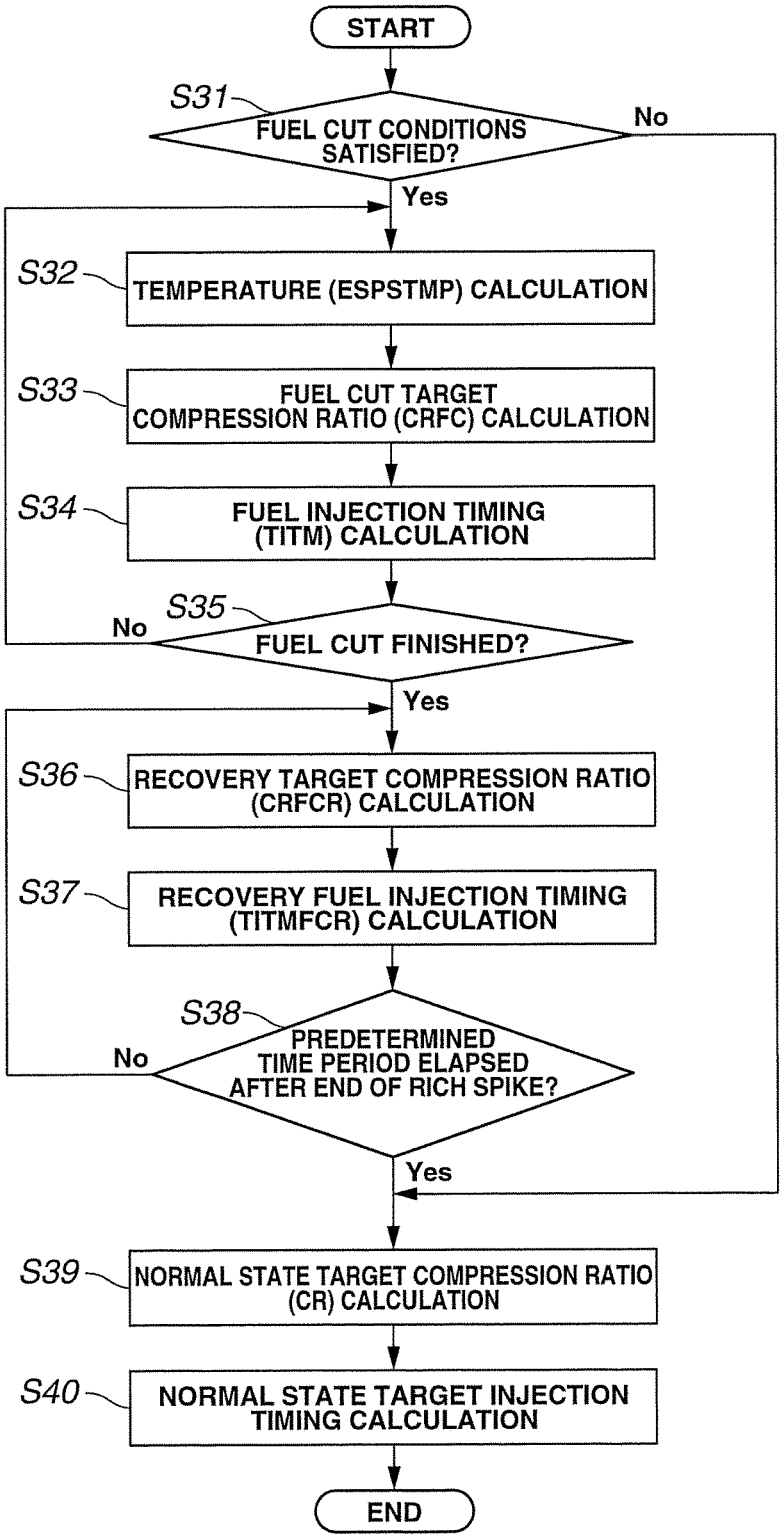
FIG. 10 is a flow chart showing a flow of a control in the third embodiment.
Figure 11:
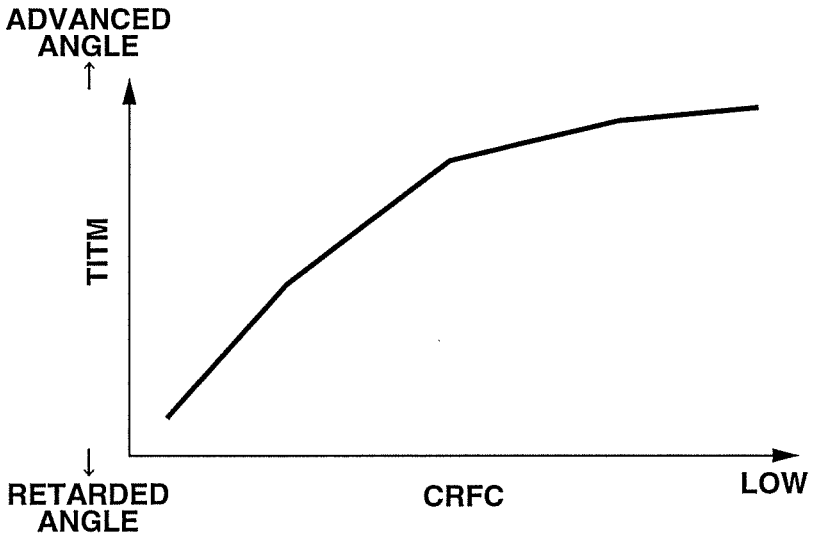
FIG. 11 is a fuel injection timing calculation map.

FIG. 10 is a flow chart showing a flow of the control of the above-described third embodiment. At S31, it is judged whether or not the fuel cut conditions are satisfied. When the fuel cut conditions are satisfied, the process proceeds to S32. When the fuel cut conditions are not satisfied, the process proceeds to S39. At S32, the piston temperature (ESPSTMP) is calculated from the predetermined calculation formula by using the engine load immediately before the fuel cut control, and the accumulated intake air amount during the fuel cut control, and so on. Besides, the piston temperature (ESPSTP) may be calculated by using the coolant temperature of the internal combustion engine 1, and the oil temperature of the engine oil. At S33, the fuel cut target compression ratio (CRFC) which is the target value of the compression ratio during the fuel cut is calculated. This fuel cut target compression ratio (CRFC) is calculated, for example, by using the above-described fuel cut target compression ratio calculation map shown in FIG. 5. The fuel cut target compression ratio (CRFC) becomes lower as the piston temperature (ESPSTMP) becomes lower. Besides, the fuel cut target compression ratio is set so that the discharge amount of the exhaust particulate is not largely deteriorated even when the fuel is injected from the first fuel injection valve 11 at this compression ratio.

At S34, the fuel injection timing (TITM) is calculated. This fuel injection timing (TITM) is calculated, for example, by using a fuel injection timing calculation map shown in FIG. 11. The fuel injection timing (TITM) is advanced as the fuel cut target compression ratio (CRFC) becomes lower.

At S35, it is judged whether or not the fuel cut is finished. That is, it is judged whether or not the fuel cut recovery conditions are satisfied. When the fuel cut recovery conditions are satisfied, the process proceeds to S36. When the fuel cut recovery conditions are not satisfied, the process proceeds to S32. At S36, the recovery target compression ratio (CRFCR) which is the target compression ratio during the rich spike is set to the fuel cut target compression ratio (CRFC) which is calculated immediately before the satisfaction of the fuel cut recovery conditions. At S37, the recovery fuel injection timing (TITMFCR) is set to the fuel injection timing (TITM) calculated immediately before the satisfaction of the fuel cut recovery conditions. At S38, it is judged whether or not the rich spike is finished. Specifically, when the predetermined time period elapses from the end of the rich spike, the process proceeds to S39. Otherwise, the process proceeds to S36. Besides, at S38, it may be set that the process proceeds to S39 when the rich spike is finished. At S39, the target compression ratio (CR) is set to the normal state compression ratio (CR) calculated from the above-described normal state compression ratio calculation map of FIG. 2 by using the current engine load and the current engine speed. At S40, the normal state target injection timing is calculated by using the current engine load and the current engine speed. The normal state target injection timing can be calculated, for example, by using a map and so on.

Besides, in a configuration where the first fuel injection valve 11 is disposed on the upper wall of the combustion chamber 2 which confronts the piston 9, the reduction effect of the fuel adhesion to the piston 9 becomes large, relative to a configuration where the first fuel injection valve 11 is disposed on a side portion of the combustion chamber 2 on the intake passage's side. Moreover, the reduction effects of the discharge number of the exhaust particulate and the discharge amount of the exhaust particulate become large.

The compression ratio at the satisfaction of the fuel cut recovery conditions may be set to be smaller as the engine speed at the satisfaction of the fuel cut recovery conditions becomes smaller.

The lowering speed of the piston 9 becomes slower as the engine speed becomes lower. Accordingly, the upper dead center position of the piston 9 is set to the lower position as the engine speed at the satisfaction of the fuel cut recovery condition becomes lower. This is advantageous for the reduction of the fuel adhesion to the piston 9.

Moreover, the compression ratio at the satisfaction of the fuel cut recovery conditions may be set to be lower as the engine load at the satisfaction of the fuel cut recovery conditions becomes higher.

The fuel injection amount is increased as the engine speed becomes higher. Accordingly, the upper dead position of the piston 9 is set to the lower position as the engine load at the satisfaction of the fuel cut recovery conditions becomes higher. This is advantageous for the reduction of the fuel adhesion to the piston 9.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A control device for an internal combustion engine, comprising:

a controller configured to control a fuel injection valve arranged to directly inject a fuel into a combustion chamber, and a variable compression ratio mechanism arranged to vary an upper dead center position of a piston, and thereby to vary a compression ratio of the internal combustion engine, wherein the controller is configured to control a fuel cut by which the fuel injection from the fuel injection valve is stopped, when a predetermined fuel cut condition is satisfied during a traveling of a vehicle, wherein the fuel injection from the fuel injection valve is restarted when a predetermined fuel cut recovery condition is satisfied during the fuel cut, wherein the compression ratio at the restart of the fuel injection from the fuel cut being set to be smaller than a normal state compression ratio determined in accordance with a driving state as a temperature of a wall surface of the combustion chamber becomes lower, so as to decrease adhesion of the fuel injected from the fuel injection valve into a cylinder to the piston, wherein a rich spike by which the fuel injection amount from the fuel injection valve is temporarily increased is performed at the restart of the fuel injection from the fuel cut; and the compression ratio is finished to be returned to the normal state compression ratio after the end of the rich spike.

2. The control device for the internal combustion engine as claimed in claim 1, wherein the compression ratio of the internal combustion engine is previously decreased during the fuel cut.

3. The control device for the internal combustion engine as claimed in claim 1, wherein the compression ratio at the restart of the fuel injection from the fuel cut is set to be smaller than the normal state compression ratio as a period of the fuel cut becomes longer.

4. The control device for the internal combustion engine as claimed in claim 1, wherein a fuel injection timing at the restart of the fuel injection from the fuel cut is advanced as the compression ratio set at the restart of the fuel injection is smaller than the normal state compression ratio.

5. The control device for the internal combustion engine as claimed in claim 1, wherein the compression ratio at the restart of the fuel injection from the fuel cut is lowered as an engine speed at the satisfaction of the fuel cut recovery condition becomes lower.

6. The control device for the internal combustion engine as claimed in claim 1, wherein the compression ratio at the restart of the fuel injection from the fuel cut is lowered as an engine load at the satisfaction of the fuel cut recovery condition becomes higher.

* * * * *